US007740420B2

(12) United States Patent
Jones et al.

(10) Patent No.: US 7,740,420 B2
(45) Date of Patent: Jun. 22, 2010

(54) RETAINING WALL HAVING ARTIFICIAL GRASS REINFORCING FABRIC AND METHODS FOR INSTALLING THE FABRIC THERETO

(75) Inventors: David Michael Jones, Dacula, GA (US); Greg Lloyd Maxwell, Pendergrass, GA (US)

(73) Assignee: Nicolon Corporation, Pendergrass, GA (US)

( * ) Notice: Subject to any disclaimer, the term of this patent is extended or adjusted under 35 U.S.C. 154(b) by 322 days.

(21) Appl. No.: 11/706,622

(22) Filed: Feb. 13, 2007

(65) Prior Publication Data

US 2008/0193226 A1 Aug. 14, 2008

(51) Int. Cl.
*E02D 29/02* (2006.01)

(52) U.S. Cl. ..... 405/284; 405/262; 405/15

(58) Field of Classification Search ..... 405/284, 405/16, 231, 262, 286; 428/36.1, 36.2, 17, 428/15; *E02D 17/18*
See application file for complete search history.

(56) References Cited

U.S. PATENT DOCUMENTS

| | | | | |
|---|---|---|---|---|
| 4,902,540 | A * | 2/1990 | Martino | 428/17 |
| 4,960,349 | A | 10/1990 | Willibey et al. | |
| 5,586,408 | A | 12/1996 | Bergevin | |
| 5,636,938 | A * | 6/1997 | Ragazzo | 405/15 |
| 5,651,641 | A | 7/1997 | Stephens et al. | |
| 5,850,708 | A | 12/1998 | Bergevin | |
| 6,048,282 | A | 4/2000 | Prevost et al. | |
| 6,219,965 | B1 | 4/2001 | Ishikawa et al. | |
| 6,227,989 | B1 | 5/2001 | Reid | |
| 6,242,062 | B1 | 6/2001 | de Vries | |
| 6,296,422 | B1 * | 10/2001 | Ferraiolo | 405/262 |
| 6,299,959 | B1 * | 10/2001 | Squires et al. | 428/87 |
| 6,691,455 | B1 | 2/2004 | Bergevin | |
| 7,147,405 | B2 * | 12/2006 | Ferraiolo | 405/284 |
| 7,419,330 | B2 * | 9/2008 | Heselden | 405/15 |

FOREIGN PATENT DOCUMENTS

| | | |
|---|---|---|
| CA | 2238953 | 11/1999 |
| EP | 0724825 | 8/1996 |
| JP | 63277323 | 11/1988 |
| JP | 2104216 | 4/1990 |
| JP | 4207123 | 7/1992 |
| JP | 5295916 | 11/1993 |
| JP | 2001136829 | 5/2001 |
| JP | 2002167766 A * | 6/2002 |

* cited by examiner

*Primary Examiner*—Frederick L Lagman
(74) *Attorney, Agent, or Firm*—Kilpatrick Stockton LLP

(57) ABSTRACT

A reinforcing fabric for use in various applications, including retaining walls. Artificial grass is strategically provided on the fabric so that, when the fabric is positioned in the retaining wall installation, the artificial grass is at least visible on the vertical face of the wall.

19 Claims, 4 Drawing Sheets

RETAINING WALL HAVING ARTIFICIAL GRASS REINFORCING FABRIC AND METHODS FOR INSTALLING THE FABRIC THERETO

FIELD OF INVENTION

Embodiments of the present invention are directed to providing an aesthetically pleasing reinforcement fabric for retaining and supporting walls.

BACKGROUND OF THE INVENTION

Retaining walls are commonly used to stabilize various forms of earth, ranging from rocks to soil, and thereby prevent the earth from shifting and eroding. The steeper the slope on which the retaining wall is positioned, the more lateral force that the earth applies to the wall. Thus, in such steepened slope applications, it is necessary to provide retaining wall support structures with increased structural integrity to withstand such forces. Wire gabions have proven particularly suitable in such applications.

However, wire gabions are not without drawbacks. Being open wire baskets, these devices do not provide the best erosion protection for the retaining walls. Rather, dirt, rocks, and other earth are able to escape through the gabion's openings and thereby threaten the stability of a steepened slope. Moreover, surface water runoff can carry away the very earth that is being retained and result in formation of rills and gullies.

Furthermore, the wire gabions are easily visible when incorporated into a retaining wall and are not aesthetically pleasing. Thus, various attempts have been made to disguise the gabions. For example, hydroseeding has been used to promote the growth of vegetation on the retaining wall. However, if the retaining wall is especially steep and/or built to have a vertical face, it may be very difficult for vegetation to grow of the vertical face of such wall. Moreover, hydroseeding, while cheaper than sod installation, is not without cost.

While hydroseeding does address the appearance drawback of gabions, it does not significantly combat erosion. Rather, other reinforcement devices must be used in conjunction with the gabions. The devices, such as silt fences, while preventing erosion may also prevent water from escaping the installation. Such trapped water can add additional forces to the retaining wall, putting unwanted stress on the retaining structures, which could lead to the wall failure. In addition, many silt fences are composed of a plastic liner, similar to garbage bags, and are not considered visually pleasing. As such, the aesthetic problem has not been addressed.

Accordingly, there exists a need for a reinforcing structure that may be used in conjunction with wire gabions or other primary reinforcement devices that disguises the existence of such devices while helping to prevent erosion of earth from the retaining wall.

SUMMARY OF THE INVENTION

This invention relates generally to a fabric at least partially tufted with artificial grass yarns for use in various construction applications such as, but not limited to, drainage, erosion control, soil reinforcement, secondary reinforcement, soil stabilization, soil separation, earth retaining structures, steepened slopes, and embankment stabilization. The fabric is particularly well suited as a reinforcement in retaining walls. Artificial grass is strategically provided on the fabric so that, when the fabric is positioned in the retaining wall installation, the artificial grass is at least visible on the vertical face of the wall. Thus, the need for, and related complications associated with, hydroseeding are obviated. Moreover, the fabric is permeable to water but not earth and other debris. In this way, the fabric imparts an aesthetically pleasing appearance to a retaining wall installation while preventing erosion.

DETAILED DESCRIPTION OF THE INVENTION

Figure 1:
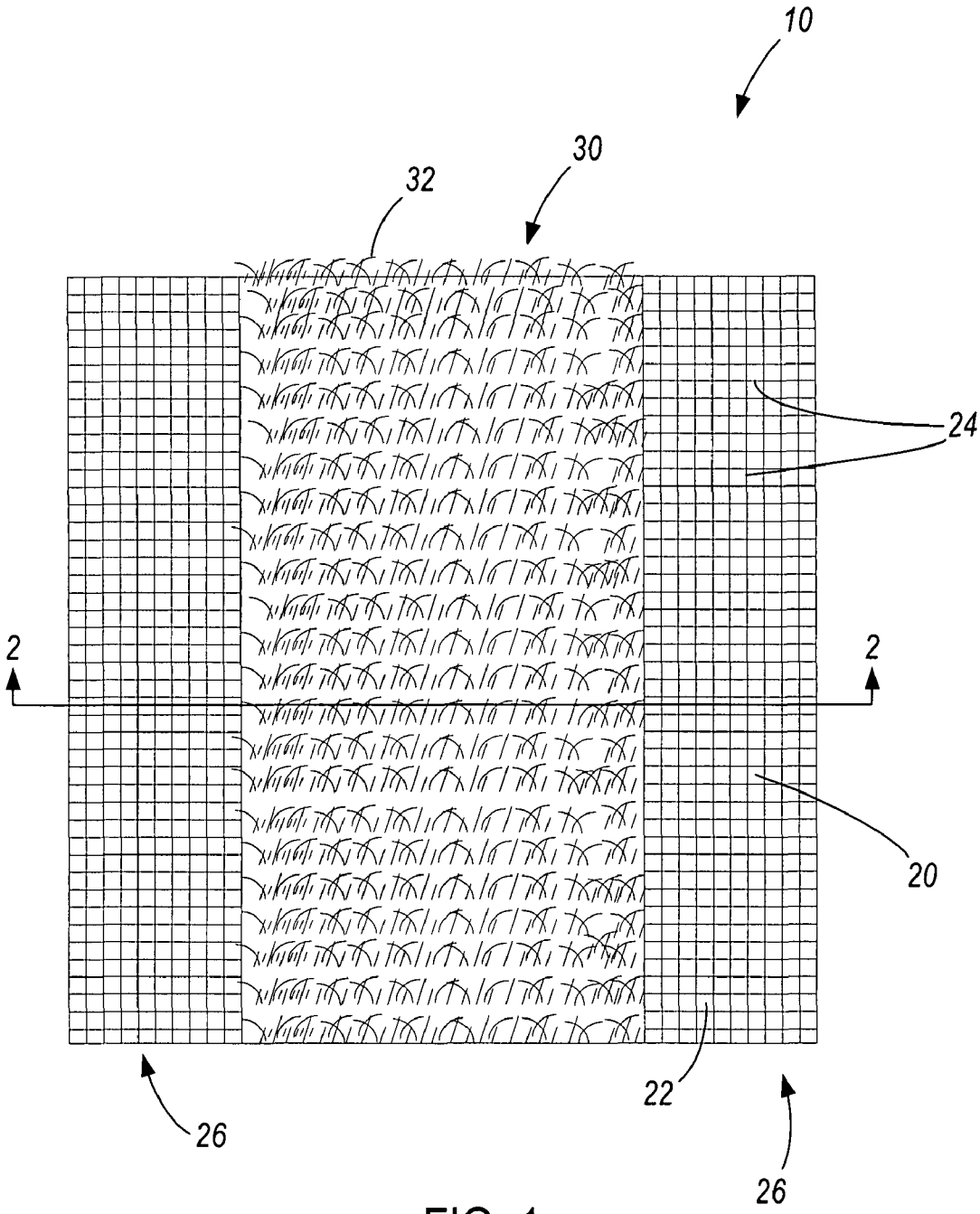
FIG. 1 is a perspective view of the reinforcement fabric according to one embodiment of the present invention.

FIG. 1 illustrates one embodiment of the reinforcing fabric of this invention. The reinforcing fabric 10 is well suited for use with wire gabions. However, the fabric 10 is not limited to such use. In this and other embodiments, the fabric 10 may be used with other primary reinforcement devices, such as, but not limited to, wire fences and mesh, for retaining wall applications.

The fabric 10 includes a base 20 and an artificial grass portion 30. The base 20 is preferably formed from high tensile strength body yarns 24 oriented (such as by cross-plying (i.e., laying yarns of one direction on top of yarns of another direction and securing them at the cross-points), knitting, welding, or weaving) to form an open grid structure with apertures 22. The body yarns 24 may be made from any natural or synthetic fiber having sufficient structural integrity to withstand the elements. The body yarns 24 are preferably made from synthetic fibers, such as polypropylene, polyester, polyethylene, etc., and may be, but do not have to be, formed from UV-resistant fibers to increase the durability of the base 20.

The apertures 22 in the base 20 permit water to the pass through the base 20 but are sized to prevent large particles of earth, such as soil or sand, from passing through the base 20. In this way, the base 20 provides erosion protection for the steepened slope without water retention, thereby insuring that the additional force of water runoff will not compromise the structural integrity of the fabric 10.

While the entirety of the base 20 may be provided with artificial grass, it is preferable that only a portion of the base 20 be so provided. More specifically, as shown in FIG. 1, the grass yarns 32 are preferably only provided on those areas of the base 20 that are intended to be exposed when the fabric is installed on the retaining wall. In this way, the fabric 10 preferably includes an artificial grass portion 30 and at least one non-tufted portion 26 (two non-tufted portions are shown in FIG. 1).

The artificial grass portion 30 includes artificial grass yarns 32 affixed to the base 20, such as via tufting, fusion-bonding, or other methods well known in the art. The grass yarns 32 may be made from any natural or synthetic fiber having sufficient structural integrity to withstand the elements. The grass yarns 32 are preferably made from synthetic fibers, such as polypropylene, polyester, polyethylene, etc., and may be, but do not have to be, comprised of UV resistant fibers as well. The grass yarns 32 may be any color but a shade of green is particularly suitable in this application. Moreover, if tufted, the artificial grass pile is preferably cut to simulate the appearance of real grass.

The grass yarns 32 may be tufted into the base 20 using a standard tufting machine well known in the art. For example, the artificial grass portion 30 may be tufted at a ⅜ gauge. However, in this and other embodiments, the gauge is not limited as such.

While an adhesive coating may be applied to the undersurface of the fabric 10 to lock the grass yarns 32 into the base 20, such an adhesive detrimentally impacts the water permeability of the fabric. As such, when the fabric is installed relative to a retaining wall (as discussed in more detail below), water could collect behind the grass portion 30 of the fabric 10. Water pressure would thus build behind the fabric and thereby compromise the fabric's strength and durability in the installation.

Figure 2:
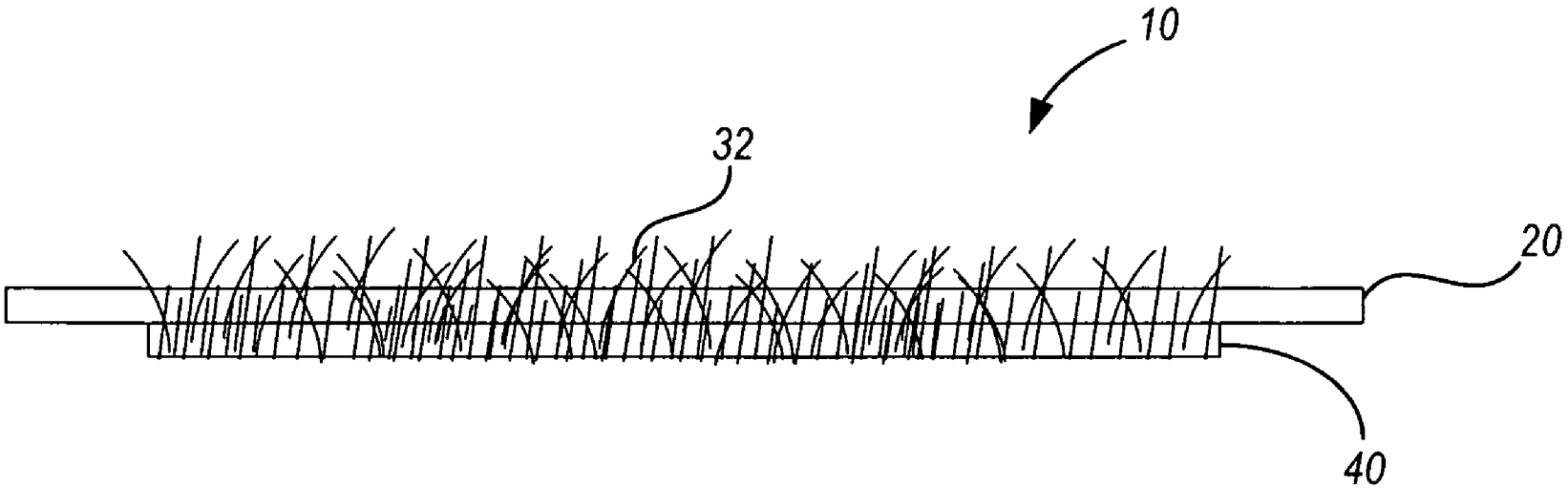
FIG. 2 is a cross-section taken along line 2-2 in FIG. 1.

Thus, instead of an adhesive, the present invention preferably incorporates a non-woven backing 40 into the fabric construction. The non-woven backing is positioned adjacent the base 20 prior to tufting so that the grass yarns 32 are tufted into and through both the base 20 and the non-woven backing 40, as shown in FIG. 2. The non-woven backing 40 serves to secure the tufted grass yarns 32 in the fabric while still allowing water to flow through the fabric. The non-woven backing 40 may be made from any natural fiber (e.g., wool, cotton, flax, hemp, jute, kenaf, sugarcane, and other naturally occurring cellulosic derivatives) or synthetic fiber (e.g., polypropylene, polyethylene, and polyester fibers). The backing 40 may be formed into a stable network using conventional techniques, including needle-punching, spin-bonding, spin-lacing, carded thermo-bonding and weaving methods.

Figure 3:
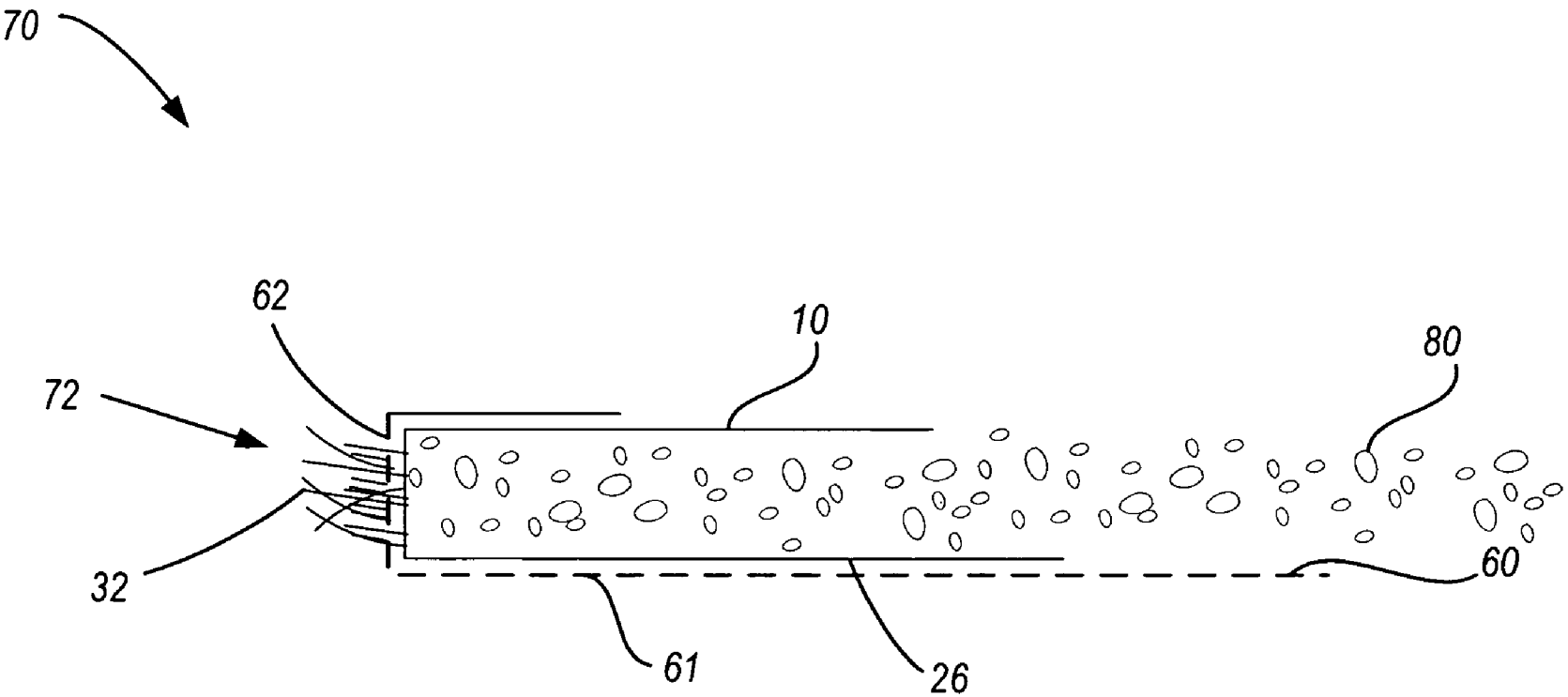
FIG. 3 is a cross-sectional view of an embodiment of the reinforcing fabric of this invention in a retaining wall installation.

During construction of a retaining wall 70, a primary reinforcement, such as gabion 60, is installed. The gabion 60 includes a substantially horizontal component 61 and a substantially vertical component 62. Reinforcing fabric 10 is then positioned relative to the gabion 60 (see FIG. 3). A non-tufted portion 26 of the fabric 10 is positioned to lay adjacent the horizontal component 61 of the gabion 60 substantially parallel to the underlying earth. The fabric 10 is then bent so that the grass portion 30 is substantially parallel to the vertical component 62 of the gabion 60 and is visible on the vertical face 72 of the wall 70 through the gabion 60. Once in place, earth 80 is backfilled into the gabion 60 so as to contact the undersurface of the fabric 10. The fabric 10 is then wrapped so as to lay on top of the deposited earth 80. While not shown in the drawings, the portion of the fabric 10 that lays on the deposited earth 80 may also be, but certainly does not have to be, tufted with artificial grass to impart a grassy appearance without hydroseeding.

Figure 4:
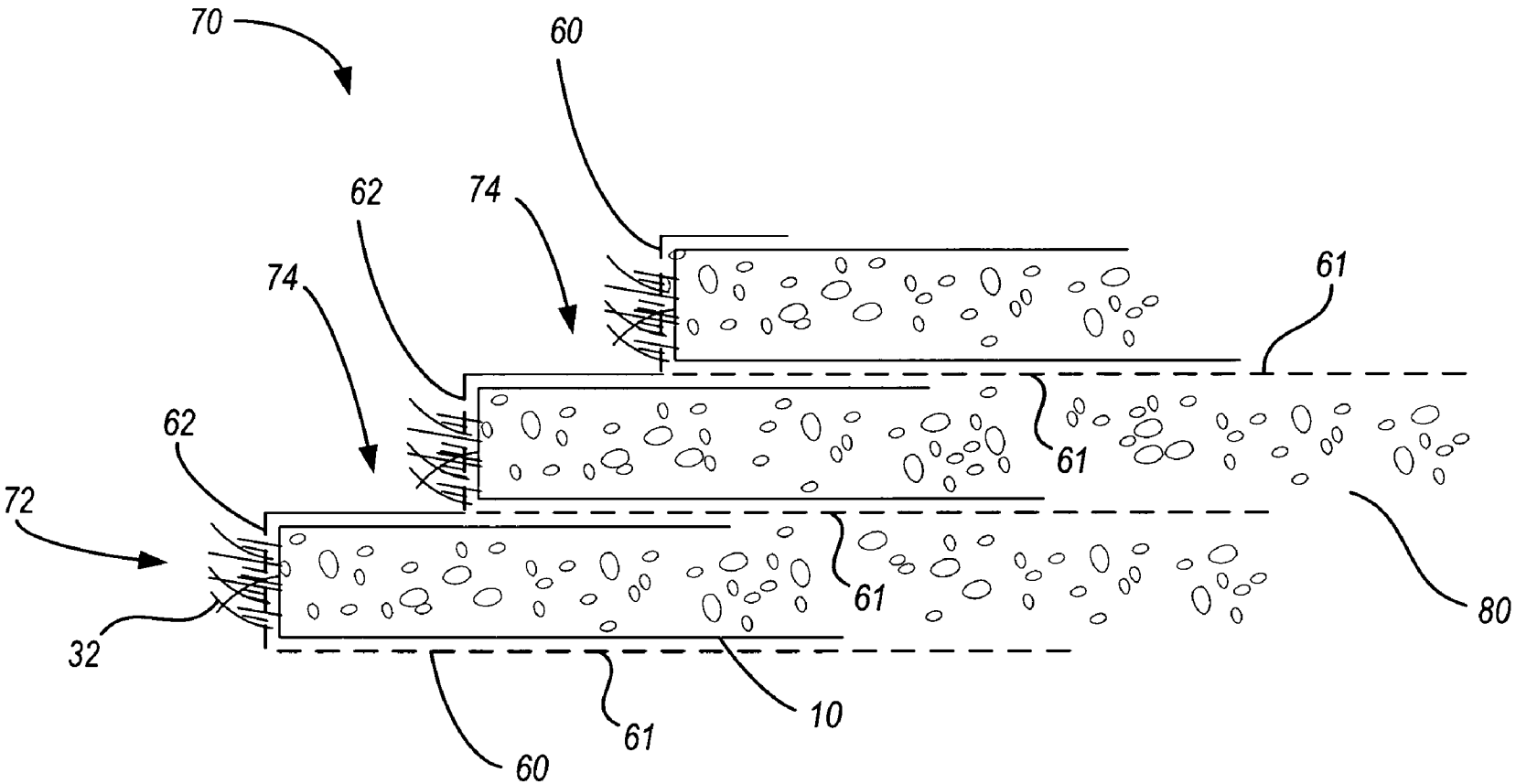
FIG. 4 is a cross-sectional view of an embodiment of the reinforcing fabric of this invention positioned in a tiered retaining wall installation.

The fabric 10 may also be used in tiered retaining wall systems, such as the one disclosed in FIG. 4. The fabric 10 may be installed in each tier as described above. Moreover, the fabric 10 may be, but does not have to be, provided with enough artificial grass 32 so that, in addition to the vertical face 72 of the wall 70, the horizontal ledge 74 between adjacent vertical wall faces 72 is also covered with artificial grass (not shown).

As various modifications could be made in the constructions and methods herein described and illustrated without departing from the scope of the invention, it is intended that all matter contained in the foregoing description or shown in the accompanying drawings shall be interpreted as illustrative rather than limiting. For example, the fabrics and techniques described herein may be used with either wire gabions or wire fencing reinforcement devices, or other types of retaining walls. Thus, the breadth and scope of the present invention should not be limited by any of the above-described exemplary embodiments, but should be defined only in accordance with the following claims appended hereto and their equivalents.

We claim:

1. A retaining wall comprising:

a. at least one primary reinforcement device, comprising:
   i. a generally vertical component; and
   ii. a generally horizontal, substantially planar component; and b. a reinforcement fabric positioned adjacent to the horizontal and vertical components of the primary reinforcement device, the fabric comprising:
   i. a reinforcing base; and
   ii. artificial grass yarns projecting from the base proximate the vertical component so that at least some of the artificial grass yarns are exposed.

2. The retaining wall of claim 1, wherein the base comprises a grid.

3. The retaining wall of claim 2, wherein the grid is woven, knitted, cross-plied, or welded.

4. The retaining wall of claim 1, wherein the artificial grass yarns are tufted into the base.

5. The retaining wall of claim 1, wherein at least a portion of the base is provided without artificial grass yarns.

6. The wall of claim 5, wherein the portion of the base without artificial grass yarns is positioned proximate the generally horizontal, substantially planar component.

7. The retaining wall of claim 1, wherein the reinforcement fabric further comprises a non-woven fabric positioned adjacent a side of the base.

8. The retaining wall of claim 7, wherein the artificial grass yarns are tufted into the base and the non-woven fabric.

9. The retaining wall of claim 1, wherein the primary reinforcement device is a gabion.

10. The retaining wall of claim 1, wherein the base and artificial grass yarns comprise UV resistant yarns.

11. A retaining wall comprising:

a. a reinforcement fabric comprising:
   i. a woven reinforcing base having a first portion and second portion;
   ii. artificial grass yarns; and
   iii. a non-woven fabric adjacent a back side of the base, wherein the artificial grass yarns are only tufted into the first portion of the base and the non-woven fabric; and b. at least one gabion comprising;
   i. a generally vertical component having a bottom; and
   ii. a generally horizontal, substantially planar component extending from the bottom of the vertical component;

wherein the first portion of the reinforcement fabric is positioned proximate the vertical component so that at least some of the artificial grass yarns extend through the gabion and are exposed on the wall and the second portion of the base is positioned proximate the generally horizontal, substantially planar component.

12. A method for installing a reinforcing fabric in a retaining wall comprising:

a. providing a primary reinforcement device comprising:
   i. a generally vertical component; and
   ii. a generally horizontal, substantially planar component;

b. providing a reinforcing fabric comprising a base, wherein a first portion of the base is provided with artificial grass yarns; and c. positioning the fabric proximate the vertical component so that the at least some of the artificial grass yarns are exposed.

13. The method of claim 12, wherein a second portion of the base is provided without artificial grass yarns.

14. The method of claim 12, wherein the base further comprises a non-woven fabric positioned adjacent a side of the base.

15. The method of claim 14, wherein the artificial grass yarns are tufted into the first portion of the base and the non-woven fabric.

16. The method of claim 12, wherein the primary reinforcement structure is a gabion.

17. The method as recited in claim 16, wherein a second portion of the base is provided without artificial grass yarns and wherein positioning the fabric further comprises positioning the second portion of the base substantially parallel to the generally horizontal, substantially planar component of the gabion.

18. The method of claim 17, further comprising depositing earth on top of the fabric.

19. The method of claim 18, further comprising wrapping the fabric over at least a portion of the deposited earth.

* * * * *

UNITED STATES PATENT AND TRADEMARK OFFICE

CERTIFICATE OF CORRECTION

PATENT NO. : 7,740,420 B2
APPLICATION NO. : 11/706622
DATED : June 22, 2010
INVENTOR(S) : David Michael Jones and Greg Lloyd Maxwell It is certified that error appears in the above-identified patent and that said Letters Patent is hereby corrected as shown below:

Column 2, Line 43. Please delete third "the"

Column 4, Lines 2-16. Please correct the spacing of the last line of claim 1 as follows:

1. A retaining wall comprising:

a. at least one primary reinforcement device, comprising:

i. a generally vertical component; and ii. a generally horizontal, substantially planar component; and b. a reinforcement fabric positioned adjacent to the horizontal and vertical components of the primary reinforcement device, the fabric comprising:

i. a reinforcing base; and ii. artificial grass yarns projecting from the base proximate the vertical component so that at least some of the artificial grass yarns are exposed.

Signed and Sealed this

Third Day of August, 2010

David J. Kappos

David J. Kappos
*Director of the United States Patent and Trademark Office*